US010467975B2

(12) United States Patent
Suh et al.

(10) Patent No.: US 10,467,975 B2
(45) Date of Patent: Nov. 5, 2019

(54) DISPLAY DRIVING DEVICE AND DISPLAY DEVICE

(71) Applicant: Samsung Electronics Co., Ltd., Suwon-si, Gyeonggi-do (KR)

(72) Inventors: Dong Wook Suh, Bucheon-si (KR); Chang Hee Shin, Gimpo-si (KR); Hong Keun Yune, Seoul (KR); Seong Min Cheon, Hwaseong-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 248 days.

(21) Appl. No.: 15/362,946

(22) Filed: Nov. 29, 2016

(65) Prior Publication Data

US 2017/0270863 A1 Sep. 21, 2017

(30) Foreign Application Priority Data

Mar. 17, 2016 (KR) ..... 10-2016-0032226
Jun. 23, 2016 (KR) ..... 10-2016-0078475

(51) Int. Cl.
*G09G 3/3258* (2016.01)
*G09G 3/36* (2006.01)
*G09G 3/3291* (2016.01)

(52) U.S. Cl.
CPC ..... *G09G 3/3648* (2013.01); *G09G 3/3291* (2013.01); *G09G 3/3688* (2013.01); *G09G 2310/027* (2013.01); *G09G 2310/0291* (2013.01); *G09G 2310/08* (2013.01)

(58) Field of Classification Search
CPC ..... G09G 2310/027; G09G 2310/0291; G09G 2310/08; G09G 3/3291; G09G 3/3648; G09G 3/3688
See application file for complete search history.

(56) References Cited

U.S. PATENT DOCUMENTS 5,903,250 A 5/1999 Lee et al.
2007/0018923 A1* 1/2007 Yokota ..... G09G 3/3688 345/89
2011/0242145 A1* 10/2011 Nishimura ..... G09G 3/3688 345/690
2013/0162617 A1* 6/2013 Yoon ..... G09G 3/3291 345/211
2013/0285998 A1* 10/2013 Hong ..... G06F 3/038 345/212

* cited by examiner

*Primary Examiner* — Afroza Chowdhury
(74) *Attorney, Agent, or Firm* — Harness, Dickey & Pierce, P.L.C.

(57) ABSTRACT

A display driving device includes a digital-to-analog converter generating analog image data, a plurality of pads connected to a plurality of data lines included in a display panel, a buffer circuit having a plurality of buffers receiving the analog image data to generate a data voltage, a first switch connected between an output terminal of the plurality of buffers and the plurality of pads, and a second switch connected between an input terminal of the plurality of buffers and the digital-to-analog converter, and a controller turning the first switch off and turning the second switch on to set at least a partial output of the plurality of buffers as new data voltages when the data voltage is output to the plurality of data lines through the plurality of pads.

19 Claims, 10 Drawing Sheets

DISPLAY DRIVING DEVICE AND DISPLAY DEVICE

CROSS-REFERENCE TO RELATED APPLICATION

This U.S. non-provisional application claims the benefit of priority to Korean Patent Application Number 10-2016-0032226, filed on Mar. 17, 2016 and Korean Patent Application No. 10-2016-0078475, filed on Jun. 23, 2016, both filed in the Korean Intellectual Property Office (KIPO), the disclosures of both of which are incorporated herein by reference in their entirety.

BACKGROUND

1. Field

Various example embodiments of the present inventive concepts relate to a display driving device and/or a display device.

2. Description of Related Art

Display devices, such as liquid crystal display (LCD) devices, organic light emitting display (OLED) devices, and the like, have been used in various capacities, not only to household and industrial display devices such as TVs, monitors, and the like, but also to mobile devices such as tablet PCs, smartphones, laptop computers, etc. Recently, research into display devices having high resolutions while also consuming lower amounts of power has been actively undertaken. As the display resolutions of display devices have increased, the time for which a driving line connected to a plurality of pixels is operated and the time for which a data signal is reflected in the plurality of pixels may be reduced. In a case in which a data signal is not sufficiently reflected in each pixel, distortion may occur in an image displayed by the display device. Thus, methods of sufficiently reflecting the data signal in the plurality of pixels within a short time are desired.

SUMMARY

Some example embodiments of the present inventive concepts may provide a display driving device and/or a display device, reducing and/or preventing image quality distortion and degradation and is capable of being operated with low power consumption.

According to at least one example embodiment of the present inventive concepts, a display driving device may include a digital-to-analog converter configured to generate analog image data, a plurality of pads connected to a plurality of data lines included in a display panel, a buffer circuit including a plurality of buffers, a first switch, and a second switch, the plurality of buffers are each configured to generate data voltages based on the analog image data, the first switch connected between output terminals of the plurality of buffers and input terminals of the plurality of pads, and the second switch connected between input terminals of the plurality of buffers and an output of the digital-to-analog converter and the second switch is configured to receive the analog image data output from the digital-to-analog converter and input the analog image data to the plurality of buffers, and a controller configured to turn the first switch off and turn the second switch on to set an output of at least one of the plurality of buffers to a new data voltage when the generated data voltage is being output from the plurality of pads to the plurality of data lines.

According to at least one example embodiment of the present inventive concepts, a display driving device may include a latch circuit configured to sample and store digital image data, a shift register configured to control a sampling timing of the latch circuit, a digital-to-analog converter configured to generate analog image data based on the digital image data stored in the latch circuit, a plurality of buffers configured to receive the analog image data and generate a data voltage based on the received analog image data, a plurality of pads connecting output terminals of each of the plurality of buffers to a plurality of data lines, and at least one of the plurality of buffers is configured to output the data voltage to at least one of the plurality of data lines through at least one of the plurality of pads after a delay time has elapsed.

According to at least one example embodiment of the present inventive concepts, a display device may include a display panel having a plurality of first pixels disposed on a first gate line and a plurality of second pixels disposed on a second gate line, a data driver including a plurality of buffers and configured to output a first data voltage to the plurality of first pixels of the display panel during a first period, and output a second data voltage to the plurality of second pixels of the display panel during a second period following the first period, and a controller configured to update an output of at least one of the plurality of buffers of the data driver to the second data voltage, during the first period.

According to at least one example embodiment of the present inventive concepts, a display driving device may include a controller configured to generate a first control signal, a second control signal, and a third control signal based on a first period, the first period including a delay time, a data driver including a latch circuit and a digital-to-analog converter, the latch circuit configured to receive first digital image data from an external source and output the received first digital image data based on the first control signal, and the digital-to-analog converter configured to receive the first digital image data from the latch circuit, convert the first digital image data to first analog image data, a buffer circuit configured to buffer the first analog image data based on the second control signal, and transmit the buffered first analog image data based on the third control signal, a display device configured to display an image based on the first analog image data transmitted by the buffer circuit, and the controller further configured to transmit the second control signal and not transmit the third control signal based on the delay time.

BRIEF DESCRIPTION OF DRAWINGS

The above and other aspects, features and other advantages of various example embodiments of the present inventive concepts will be more clearly understood from the following detailed description taken in conjunction with the accompanying drawings, in which.

DETAILED DESCRIPTION

Various example embodiments of the present inventive concepts will now be described in detail with reference to the accompanying drawings.

Figure 1:
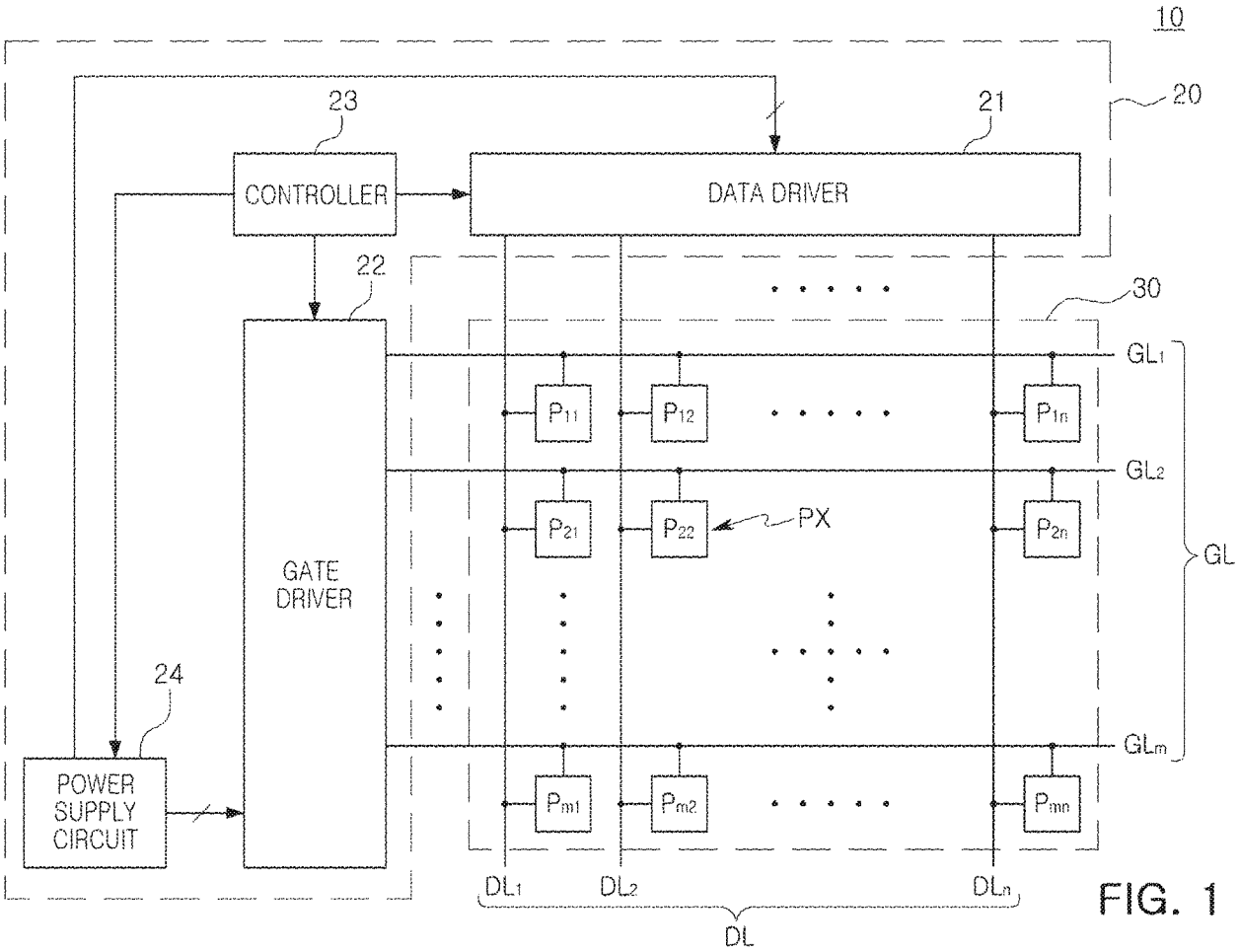
FIG. 1 is a block diagram provided to illustrate a display device including a display driving device according to at least one example embodiment.

FIG. 1 is a block diagram provided to illustrate a display device including a display driving device according to at least one example embodiment.

With reference to FIG. 1, a display device 10 according to at least one example embodiment may include a display driving device 20 and a display panel 30 (e.g., a LCD panel, a OLED panel, etc.). The display driving device 20 may include a data driver 21, a gate driver 22, a controller 23, a power supply circuit 24, and the like, but is not limited thereto.

The panel 30 may include at least one substrate (not shown), a plurality of gate lines GL (e.g., gate lines $GL_1$ to $GL_m$), and a plurality of data lines DL (e.g., data lines $DL_1$ to $DL_n$) are arranged to intersect each other on the substrate. A plurality of pixels PX (e.g., $P_{11}$ to $P_{1n}$, $P_{21}$ to $P_{2n}$, $P_{m1}$ to $P_{mn}$) may be defined at respective points of intersection of the plurality of gate lines GL and the plurality of data lines DL. The plurality of pixels may be arranged in a matrix layout according to at least one example embodiment. In at least one example embodiment, a plurality of first pixels $P_{11}$ to $P_{1n}$ may be defined by the plurality of data lines DL intersecting a first gate line GL1, and a plurality of second pixels $P_{21}$ to $P_{2n}$ may be defined by the plurality of data lines DL intersecting a second gate line GL2, etc., but are not limited thereto.

A pixel PX of the plurality of pixels may include a transistor in which a gate electrode and a source electrode are connected to at least one gate line of the plurality of gate lines GL, and at least one data line of the plurality of data lines DL, a capacitor connected to a drain electrode of the transistor, and the like. The capacitor may include a storage capacitor, and a liquid crystal capacitor may be further connected thereto when the display device 10 is a liquid crystal display (LCD) device according to at least one example embodiment. When the display device 10 is an organic light emitting display (OLED) device, the capacitor may be used as a capacitor for supplying a constant current to an organic electroluminescent device included in each pixel PX according to at least one example embodiment.

The controller 23 may include a timing controller, a memory circuit, and the like. The timing controller may generate a signal for controlling the timing for the driving signals, which the gate driver 22 and the data driver 21 supply to the plurality of gate lines GL and the plurality of data lines DL.

The gate driver 22 may scan the plurality of gate lines GL based on a control signal transmitted from the controller 23. In at least one example embodiment, the gate driver 22 may select at least one of the plurality of gate lines GL to apply a gate supply voltage. The selected gate line GL may be activated by the applied gate supply voltage. Additionally, the data driver 21 may input data voltages, for displaying an image, to pixels PX connected to the gate line GL activated by the gate supply voltage supplied by the gate driver 22. The data voltages may be input through the plurality of data lines DL connected to the pixels PX according to at least one example embodiment.

The data driver 21 may input data voltages to one or more of the plurality of data lines DL based on the control signal transmitted from the controller 23. The data voltages input to the one or more of the plurality of data lines DL may be generated based on data (e.g., image data) input to the data driver 21. For example, the image data may be digital image data, etc. The data voltages may be input to the data lines DL intersecting the gate line GL activated by the gate supply voltage from the gate driver 22. Accordingly, an image may be displayed based on the order in which the gate driver 22 scans the gate lines GL, or in other words, based on a horizontal line unit of the display panel 30.

The power supply circuit 24 may generate various internal voltages required for operations of the display device 10 based on an external voltage supplied from an external voltage source. The internal voltage may include a plurality of voltages (e.g., voltage values or voltage ranges) having different magnitudes. The power supply circuit 24 may include a charge pump circuit, and/or the like, to generate the internal voltage. In at least one example embodiment, the power supply circuit 24 may generate the gate supply voltage required to drive one or more of the gate lines GL based on the external voltage. The gate supply voltage may have a magnitude different from that of the external voltage according to at least one example embodiment.

Figure 2:
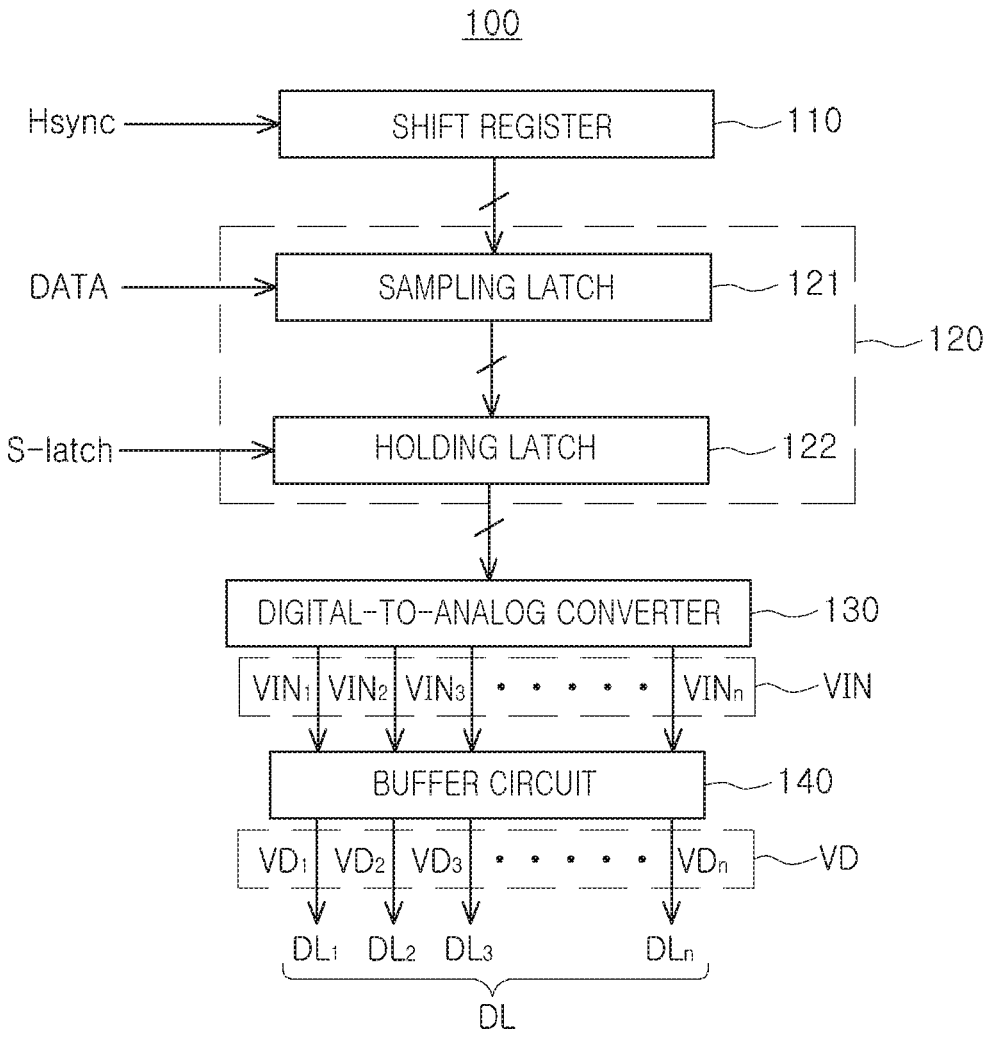
FIG. 2 is a block diagram schematically illustrating a data driver included in a display driving device according to at least one example embodiment.

FIG. 2 is a block diagram schematically illustrating a data driver included in a display driving device according to at least one example embodiment.

With reference to FIG. 2, a data driver 100 according to at least one example embodiment may include a shift register 110, a latch 120, a digital-to-analog converter 130, a buffer circuit 140, and the like, but is not limited thereto. The latch 120 may include a sampling latch 121 to sample data, and a holding latch 122 to store the data sampled by the sampling latch 121, but is not limited thereto. Each of the components 110 to 140 included in the data driver 100 is not limited to the configuration illustrated in FIG. 2, but may be variously changed to have a different form according to other example embodiments.

The shift register 110 may control the operational timing of each of a plurality of latch circuits included in the sampling latch 121 in response to a horizontal synchronization signal Hysnc. The horizontal synchronization signal Hysnc may be a signal having a desired (or alternatively, predetermined) period. The sampling latch 121 may sample data (e.g., digital image data DATA) according to a shift sequence of the shift register 110. The digital image data DATA sampled by the sampling latch 121 may be stored in the holding latch 122. The holding latch 122 may output the digital image data DATA to the digital-to-analog converter 130 in response to a second latch signal S-latch according to at least one example embodiment.

The digital-to-analog converter 130 may convert, for example, the digital image data DATA to analog image data VIN (e.g., analog image data $VIN_1$ to $VIN_n$). In at least one example embodiment, the analog image data VIN generated by the digital-to-analog converter 130 may be converted to data voltages VD (e.g., data voltages $VD_1$ to $VD_n$) by the buffer circuit 140. The plurality of data voltages VD may be output to the plurality of data lines DL (e.g., data lines $DL_1$ to $DL_n$) connected to each of a plurality of pixels, for example, the plurality of pixels PX of FIG. 1.

The data driver 100 may initiate operations (e.g., begin execution) when the horizontal synchronization signal Hsync is input to the shift register 110. The shift register 110 receiving the horizontal synchronization signal Hsync may allow a plurality of sampling circuits (not shown) included in the sampling latch 121 to be sequentially operated. The sampling latch 121 may sample the digital image data DATA to be stored in the holding latch 122.

The holding latch 122 may transfer the digital image data DATA stored to the digital-to-analog converter 130 in response to the second latch signal S-latch being received. The digital-to-analog converter 130 may convert the digital image data DATA into the analog image data VIN. The analog image data VIN may include analog data corresponding to a desired voltage to be output to each of the plurality of data lines DL. The buffer circuit 140 may generate the data voltages VD using the analog image data VIN.

The buffer circuit 140 may include a plurality of buffers (not shown) having an operational amplifier (not shown), and the plurality of buffers may be respectively connected to the plurality of data lines DL through a plurality of pads (not shown) according to at least one example embodiment, but is not limited thereto. In other words, an output terminal of each of the plurality of buffers may be connected, respectively, to the plurality of data lines DL, a switch device, a capacitor, and the like, included in each pixel PX of the plurality of pixels.

Therefore, according to the related art, when the resolution of the display device 10 is increased, the load of the buffer output terminal is increased. As the load of the buffer output terminal is increased, a slew time required to set an output of the buffer as a data voltage VD is also increased.

Moreover, when the slew time of the buffer is increased, the charging time in which a capacitor, or the like, included in the pixels PX is charged by the data voltage VD is reduced to one period of the horizontal synchronization signal Hsync, and consequently, the quality degradation of an image displayed by the display device 10 is caused. The related art addresses this problem by having the buffer be driven using a high current, and thereby reducing the slew time, but at the cost of increasing the power consumption of the display device (e.g., the display device 10).

According to at least one example embodiment, a method of operating the buffer circuit 140 is adjusted (e.g., modified and/or improved) to solve the problem described above. For example, an output of at least a portion (e.g., at least one buffer) of the plurality of buffers included in the buffer circuit 140 is updated in advance of a previous period of the horizontal synchronization signal Hsync, to solve the problem suffered by the related art described above.

Figure 3:
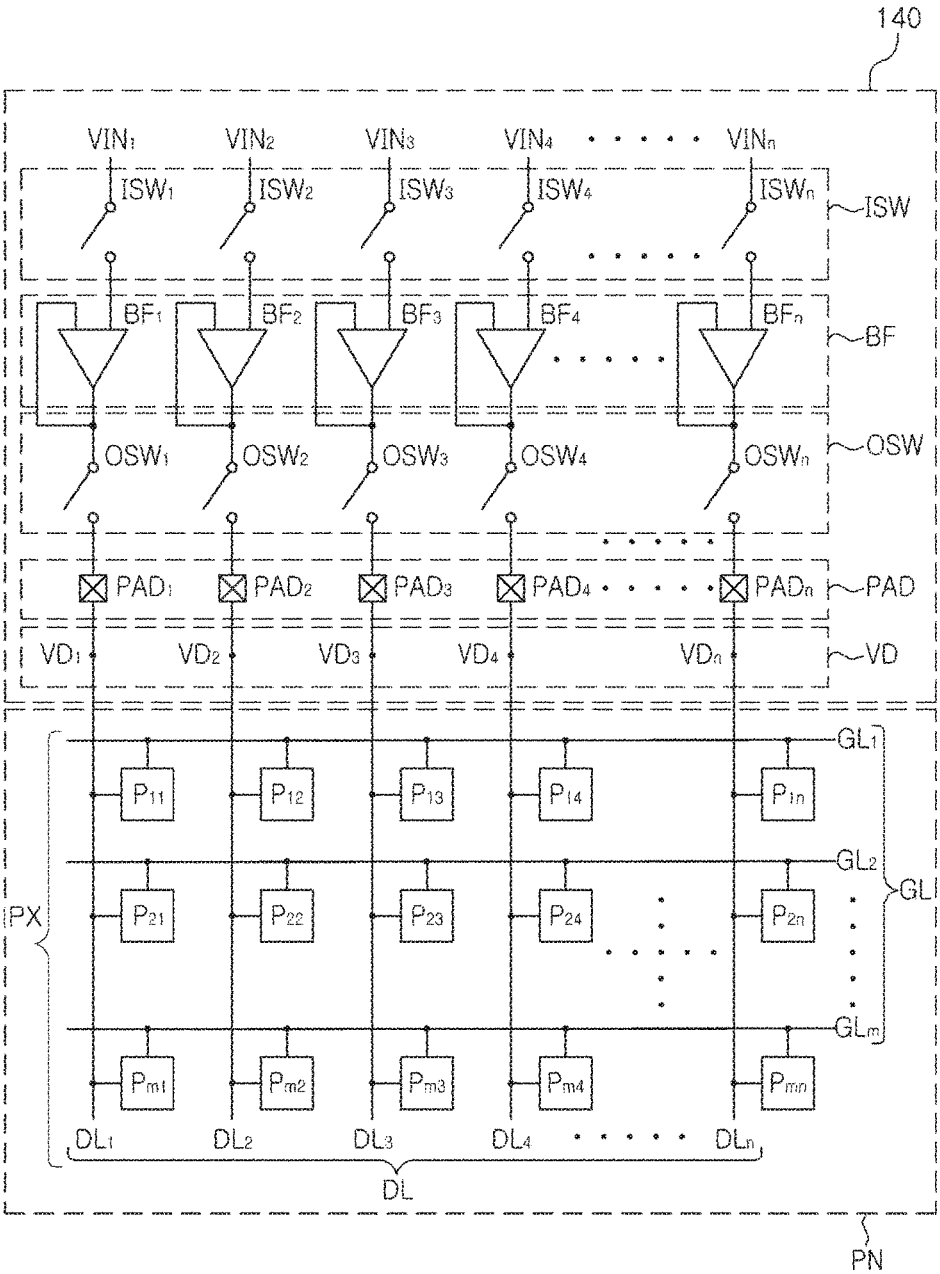
FIGS. 3 and 4 are circuit diagrams provided to illustrate operations of a display driving device according to some example embodiments.

FIG. 3 is a circuit diagram provided to illustrate operations of a display driving device according to at least one example embodiment. FIG. 3 may illustrate the buffer circuit 140 illustrated in FIG. 2 in detail.

With reference to FIG. 3, the buffer circuit 140 according to at least one example embodiment may include a plurality of first switches OSW (e.g., switches $OSW_1$ to $OSW_n$), a plurality of second switches ISW (e.g., switches $ISW_1$ to $ISW_n$), a plurality of buffers BF (e.g., buffers $BF_1$ to $BF_n$), a plurality of pads PAD (e.g., pads $PAD_1$ to $PAD_n$), and the like, but is not limited thereto. The plurality of buffers BF may include an operational amplifier (not shown), or the like. In addition, one or more of the plurality of first switches OSW may be connected to a respective one or more of the output terminals of the plurality of buffers BF, and one or more of the plurality of second switches ISW may be connected to one or more of the input terminals of a respective one or more of the plurality of buffers BF.

The plurality of pads PAD may be connected to the plurality of data lines DL (e.g., data lines $DL_1$ to $DL_n$) included in a display panel PN. In other words, when the first switch OSW is turned-on, the plurality of data voltages VD (e.g., data voltages $VD_1$ to $VD_n$) stored in the plurality of buffers BF may be input to the data lines DL through the plurality of pads PAD. In at least one example embodiment, the plurality of pads PAD may have a better response speed than that of the output terminal of the plurality of buffers BF. In other words, the slew time of the plurality of pads PAD may be shorter than that of the plurality of buffers BF.

The plurality of data voltages VD output from the plurality of pads PAD by the plurality of buffers BF, may be input to the plurality of pixels PX of the display panel PN disposed on the gate lines GL (e.g., gate lines $GL_1$ to $GL_m$) activated by a gate driver (e.g., gate driver 22 of FIG. 1). For example, when the first gate line GL1 is activated (e.g., scanned) by the gate driver, the plurality of data voltages VD output by the plurality of buffers BF may be input to a plurality of pixels (e.g., first pixels $P_{11}$ to $P_{1n}$) connected to one of the gate lines (e.g., the first gate line GL1), etc., through the plurality of pads PAD.

When a scanning period of the first gate line GL1 has been completed, or in other words, the first gate line GL1 has finished activating, the gate driver may scan the second gate line GL2, and/or the other gate lines of the plurality of gate lines. In a case of a display driving device according to the related art, after the scanning period of the second gate line GL2 begins, the first switch OSW and the second switch ISW are turned-on together (e.g., simultaneously) to store new data voltages VD in the plurality of buffers BF, and the new data voltages VD stored in the buffers BF may be updated according to the voltages to be input to the plurality of second pixels $P_{21}$ to $P_{2n}$.

In other words, in the related art, after a scanning period of each of the plurality of gate lines GL begins, data voltages VD to be input to a plurality of pixels PX connected to a scanned gate line GL may be stored in the plurality of buffers BF. Thus, due to the slew time of the operational amplifiers included in the plurality of buffers BF, the charging time for each of the plurality of pixels PX is limited, which may cause the charge of the plurality of pixels PX to be insufficiently secured. Consequently, image quality degradation may be observed in the display device. To solve the problem described above using the related art, an amount of a current is increased to reduce the slew time of the operational amplifier, but power consumption of the display device may be increased.

In at least one example embodiment, new data voltages VD may be stored in at least a portion of the plurality of buffers BF in advance to solve the problem described above. In at least one example embodiment, when the output of the plurality of data voltages VD with respect to the plurality of first pixels $P_{11}$ to $P_{1n}$ have been completed within the scanning period of the first gate line GL1, the first switch OSW may be turned-off (e.g., the first switch OSW is in the "open" position). Thus, the output terminal of each of the plurality of buffers BF may be electrically isolated from the plurality of pads PAD.

Meanwhile, while the first switch OSW is turned-off, the second switch ISW may be turned-on (e.g., the second switch ISW is in the "closed" position). When the second switch ISW is turned-on, the digital-to-analog converter 130 connected to the buffer circuit 140 may input the analog image data VIN corresponding to the data voltages VD to be output to the plurality of data lines DL within the scanning period of the second gate line GL2, to a plurality of buffers 143. Consequently, before the scanning period of the first gate line GL1 has ended, the output of at least a portion of the plurality of buffers BF may be updated in advance, in other words, during the scanning period of the first gate line GL1. Accordingly, because the first switch OSW is turned-off, the output of at least a portion of the plurality of buffers BF is updated in advance and does not need to be applied to the plurality of first pixels $P_{11}$ to $P_{1n}$.

When the scanning period of the first gate line GL1 has ended and the scanning period of the second gate line GL2 begins, the first switch OSW is turned-on to allow one or more of the output terminals of the plurality of buffers BF to be connected to the plurality of pads PAD. Thus, the output of at least a portion of the plurality of buffers BF, updated in advance during the earlier scanning period of the first gate line GL1, and may be input to the plurality of second pixels $P_{21}$ to $P_{2n}$ through the plurality of pads PAD. In this case, to update the outputs of the plurality of buffers BF that were not updated during the scanning period of the first gate line GL1, the second switch ISW may be turned-on at least one or more time during the scanning period of the second gate line GL2.

In other words, the display driving device according to at least one example embodiment may at least partially update the output of the plurality of buffers BF to new data voltages VD, after the outputs of the plurality of data voltages VD through the plurality of pads PAD have been completed during each scanning period of the gate driver (e.g., during the scanning periods of $GL_1$, $GL_2$, . . . , $GL_m$, etc.). The new data voltages VD may be a voltage to be output to the plurality of data lines DL through the plurality of pads PAD in one or more subsequent scanning periods of the gate driver.

As described previously, the plurality of buffers BF may have a relatively long slew time in comparison to the plurality of pads PAD, or in other words, the slew time of the plurality of buffers BF is longer than the slew time of the plurality of pads PAD. In at least one example embodiment, as the outputs of the plurality of buffers 143 having a relatively long slew time are updated in advance, the time required to output the data voltage VD to one or more pixels PX in each scanning period may be sufficiently secured. In other words, by having the outputs of the plurality of buffers 143 update one or more scanning periods before they are required by the one or more pixels PX, the data voltages VD output to the pixels PX may be properly charged. Thus, as the time for charging the storage capacitor, or the like, included in each pixel PX may be sufficiently secured, image quality distortion, degradation, and the like, of the display device caused by not properly and/or insufficiently securing each pixel PX may be reduced and/or prevented. Moreover, the display device may be operated using a low (and/or lower) current to reduce the power consumption of the display device.

Figure 4:
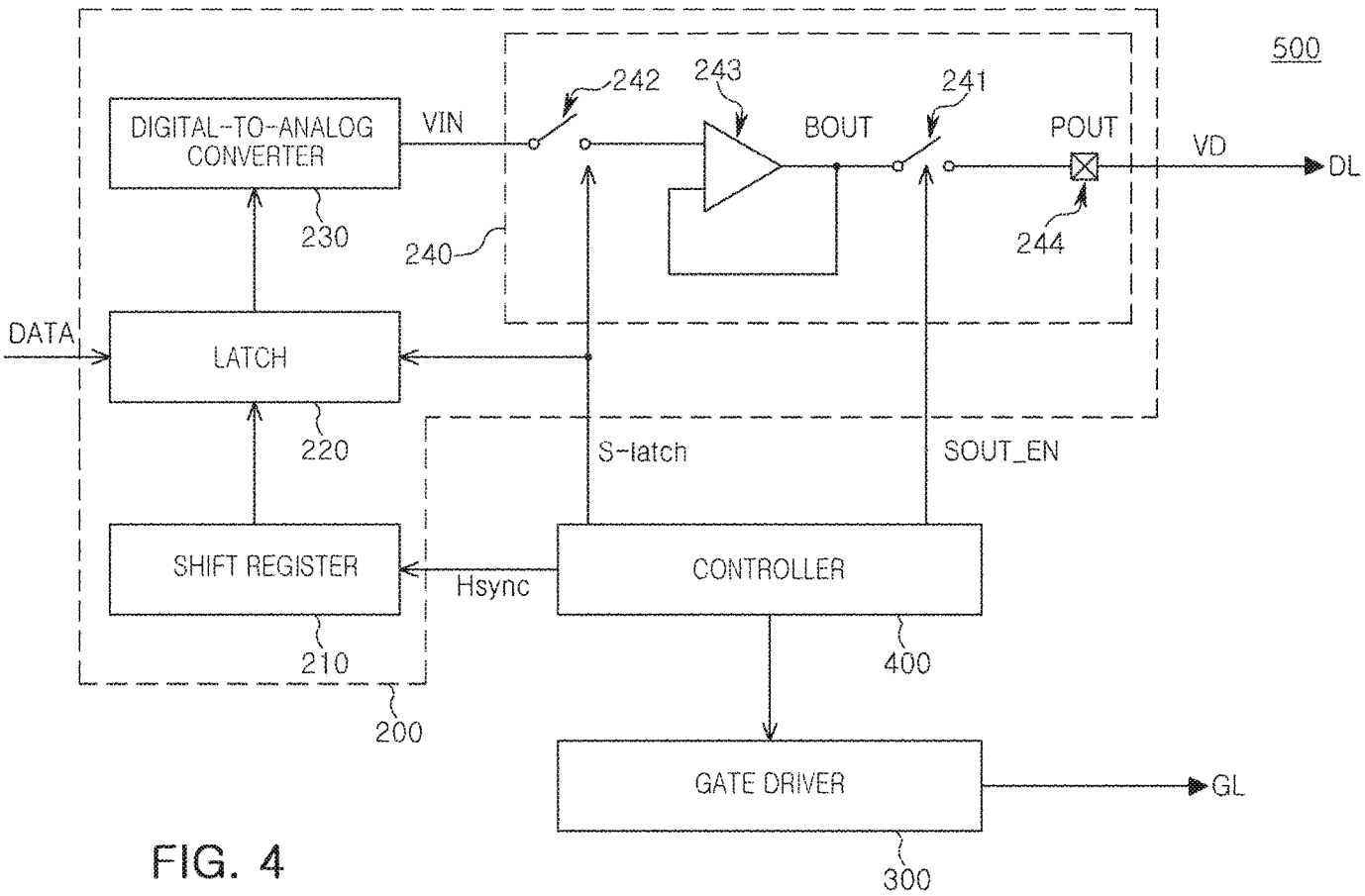
Figure 5:
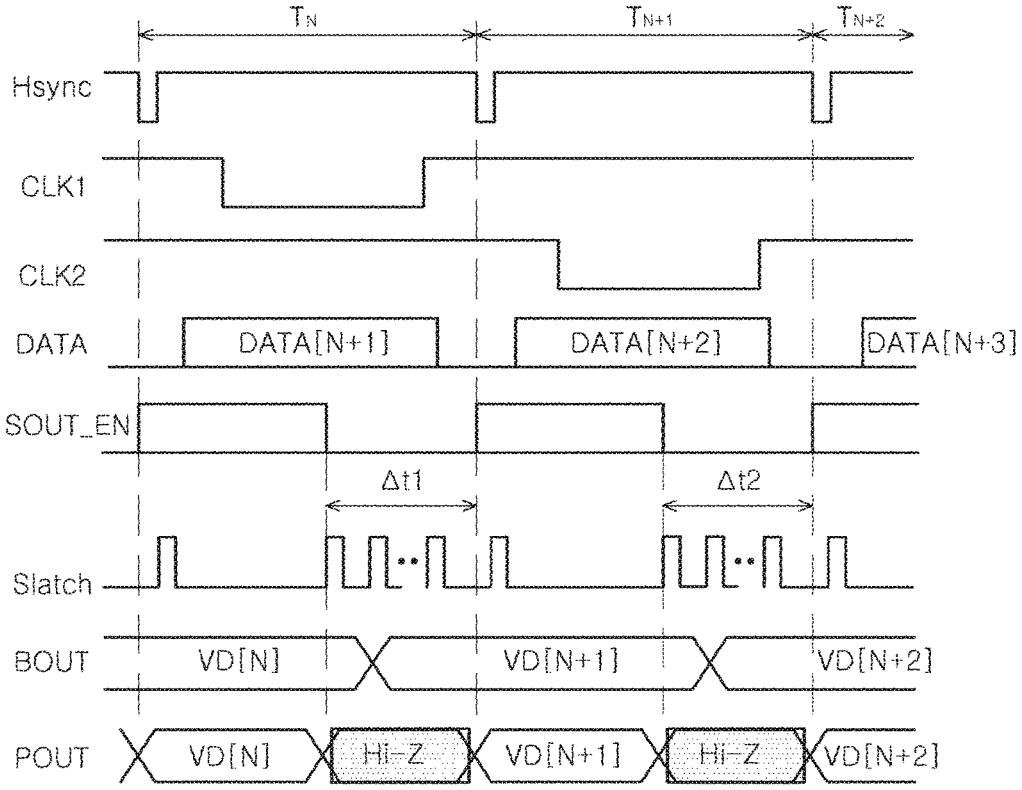
FIG. 5 is a timing diagram provided to illustrate a method of operating a display driving device according to at least one example embodiment.

FIG. 4 is a circuit diagram provided to illustrate operations of a display driving device according to at least one example embodiment. FIG. 5 is a timing diagram provided to illustrate a method of operating a display driving device according to at least one example embodiment.

With reference to FIG. 4, a display driving device 500 according to at least one example embodiment may include a shift register 210, a latch 220, a digital-to-analog converter 230, a buffer circuit 240, a gate driver 300, a controller 400, and the like, but is not limited thereto. The shift register 210, the latch 220, the digital-to-analog converter 230, and the buffer circuit 240 may be included in a data driver 200.

The buffer circuit 240 may include a buffer 243 connected to the digital-to-analog converter 230, a first switch 241 and a second switch 242 connected to the output terminal and the input terminal of the buffer 243, respectively, and the like. The buffer 243 may be implemented as an operational amplifier according to at least one example embodiment, but is not limited thereto and other types of buffers may be used as well. In addition, the output terminal of the buffer 243 may be connected to the pad POUT 244 through the first switch 241, and the input terminal of the buffer 243 may be connected to the output of the digital-to-analog converter 230 through the second switch 242. The pad POUT 244 may be connected to the data lines DL included in a display panel (e.g., display panel 30 of FIG. 1). In at least one example embodiment, the buffer circuit 240 may include a number of buffers 243 in a number corresponding to the number of the data lines DL, as illustrated, for example, in FIG. 3.

A buffer output BOUT may be determined based on the analog image data VIN output by the digital-to-analog converter 230, and the buffer output BOUT may be transferred to the data lines DL through a plurality of pads POUT 244 while the first switch 241 is turned-on (e.g., in the "closed" position). In other words, when the first switch 241 is turned-on by a first control signal SOUT_EN output by the controller 400, the buffer output BOUT may be applied (e.g., transmitted) to a pad output POUT 244.

Meanwhile, when the second switch 242 is turned-on by a second control signal S-latch output by the controller 400, in response the analog image data VIN generated by the digital-to-analog converter 230 may be output to the buffer 243. In at least one example embodiment, the second control signal S-latch may also be transmitted to latch 220, and may control the output of the latch 220. In other words, when the second switch 242 is turned-on by the second control signal S-latch, the digital-to-analog converter 230 may receive the digital image data DATA output by the latch 220 to generate the analog image data VIN. The analog image data VIN, generated from the digital image data DATA, may include data for generating a data voltage VD to be input to a data line DL.

The horizontal synchronization signal Hsync may be a signal transmitted from the controller 400 to the shift register 210 and may have a desired (and/or predetermined) period (e.g., frequency). During one period of the horizontal synchronization signal Hsync, a gate line GL may be scanned by the gate driver 300. Additionally, the display driving device 500 may input a data voltage VD to a data line DL intersecting the scanned gate line GL, during one period of the horizontal synchronization signal Hsync.

With reference to the timing diagram illustrated in FIG. 5, the buffer circuit 240 may supply a data voltage VD [N] as BOUT to a data line DL intersecting an Nth gate line GL scanned by the gate driver 300 during the period $T_N$. Meanwhile, the latch 220 may sample and store digital image data DATA[N+1] therein during the period $T_N$. The digital image data DATA[N+1] may include data for generating a data voltage VD[N+1] by the buffer circuit 240. The data voltage VD[N+1] may be a voltage to be output by the buffer circuit 240 as BOUT to a data line DL while the gate driver 300 scans an N+1th gate line GL in a subsequent period $T_{N+1}$.

Meanwhile, the first switch 241 and the second switch 242 may be controlled by the first control signal SOUT_EN and the second control signal S-latch, respectively. In the period $T_N$ of the timing diagram illustrated in FIG. 5, while the first control signal SOUT_EN has a high level (e.g., when the control signal SOUT_EN is high), the buffer output BOUT may be applied (e.g., transmitted) to the pad output POUT. The pad 244 may output the data voltage VD[N] output by the buffer 243, to a data line DL.

The display driving device 500, according to at least one example embodiment, may allow the first switch 241 to be turned off after the data voltage VD[N] is output to the data line DL through the pad 244. The first switch 241 may be turned off, as the controller 400 converts the first control signal SOUT_EN to have a low level (e.g., the signal SOUT_EN goes low). After the controller 400 allows (e.g., instructs) the first switch 241 to be turned-off, the second control signal S-latch is toggled one or more times during a time Δt1 within the period $T_N$ to allow the second switch 242 to be turned-on, and to allow the digital image data DATA [N+1] stored in the latch 220 to be output to the digital-to-analog converter 230. The time Δt1 may be considered a delay time.

Thus, during the time Δt1 included in the period $T_N$, the buffer output BOUT may be changed to the data voltage VD[N+1] to be input to the data line DL during the period $T_{N+1}$ in advance. In other words, during the time Δt1, the data voltage VD[N+1] may be stored in the buffer 243. In at least one example embodiment, the data driver 200 may include a plurality of buffers 243 and the output of at least a portion of the plurality of buffers 243 may be changed to the data voltage VD[N+1] during the time Δt1 (e.g., a portion of the output signal BOUT may be changed to VD[N+1] during the time Δt1). As the turned-off state of the first switch 241 is maintained during the time Δt1, the changed buffer output BOUT is not applied to the pad output POUT. In other words, at least a portion of the plurality of buffers 243 may output the data voltage VD[N+1], and the plurality of pads 244 may output the data voltage VD[N] during the time Δt1.

When the period $T_{N+1}$ begins, based on the horizontal synchronization signal Hsync, the controller 400 allows (e.g., transmits an instruction to) the first switch 241 to be turned-on, thereby applying (e.g., transmitting) the data voltage VD[N+1] stored in the buffer 243 to the pad output POUT. As the pad 244 has a slew time that is relatively shorter (e.g., the slew time of the pad 233 is shorter) than that of the buffer 243, the voltage of the data line DL may be changed to the data voltage VD[N+1] within a short time after the period $T_{N+1}$ begins. Thus, the time for charging each pixel PX may be sufficiently secured through the data line DL, and therefore, the image quality degradation of the display device may be reduced and/or prevented. Additionally, the display driving device 500 may be operated using less power than display driving devices according to the related art.

When the period $T_{N+1}$ begins, the controller 400 may allow (e.g., transmit instructions to) the second switch 242 to be turned-on one or more times. By the operations described above, the portions of the buffer output BOUT that were not changed to the data voltage VD[N+1] (e.g., that were left at VD[N]) during the time Δt1, may be set as the data voltage VD[N+1] during the period $T_{N+1}$.

During the period $T_{N+1}$, the operations of the display driving device 500 may be similar to the operations previously described in relation to the period $T_N$. During the period $T_{N+1}$, the gate driver 300 may scan the N+1th gate line GL. When the period $T_{N+1}$ begins, the controller 400 may allow the first switch 241 to be turned-on through the first control signal SOUT_EN. As the first switch 241 is turned-on, the buffer output BOUT is updated to the data voltage VD[N+1] during the time Δt1, which may be reflected in the pad output POUT.

Meanwhile, while the first switch 241 is turned-on in the period $T_{N+1}$, the controller 400 may allow the second switch 242 to be turned-on one or more times through the second control signal S-latch. Thus, the portion of the output BOUT of the buffer 243 that was not updated to the data voltage VD[N+1] during the time Δt1 of the period $T_N$, may be changed to VD[N+1] during the period $T_{N+1}$.

With reference to the timing diagram in FIG. 5, the latch 220 may sample and store digital image data DATA[N+2] during the period $T_{N+1}$. The digital image data DATA[N+2] may be data for generating a data voltage VD[N+2], or in other words, data that is used to generate the data voltage VD[N+2]. The data voltage VD[N+2] may be a voltage to be input to the data line DL while the gate driver 300 scans an N+2th gate line GL in a period $T_{N+2}$.

In the period $T_{N+1}$, when the output of the data voltage VD[N+1] has been completed, the controller 400 allows (e.g., instructs) the first switch 241 to be turned-off and allows (e.g., instructs) the second switch 242 to be turned-on one or more times during a time Δt2, so as to update the buffer output BOUT to the data voltage VD [N+2] at least one period (or at least one clock cycle) in advance. Thus, the time for charging each pixel PX may be sufficiently secured through the data line DL, and the image quality degradation of the display device may be reduced and/or prevented. Additionally, the display driving device 500 may be operated using less power as compared to display driving devices according to the related art.

Figure 6:
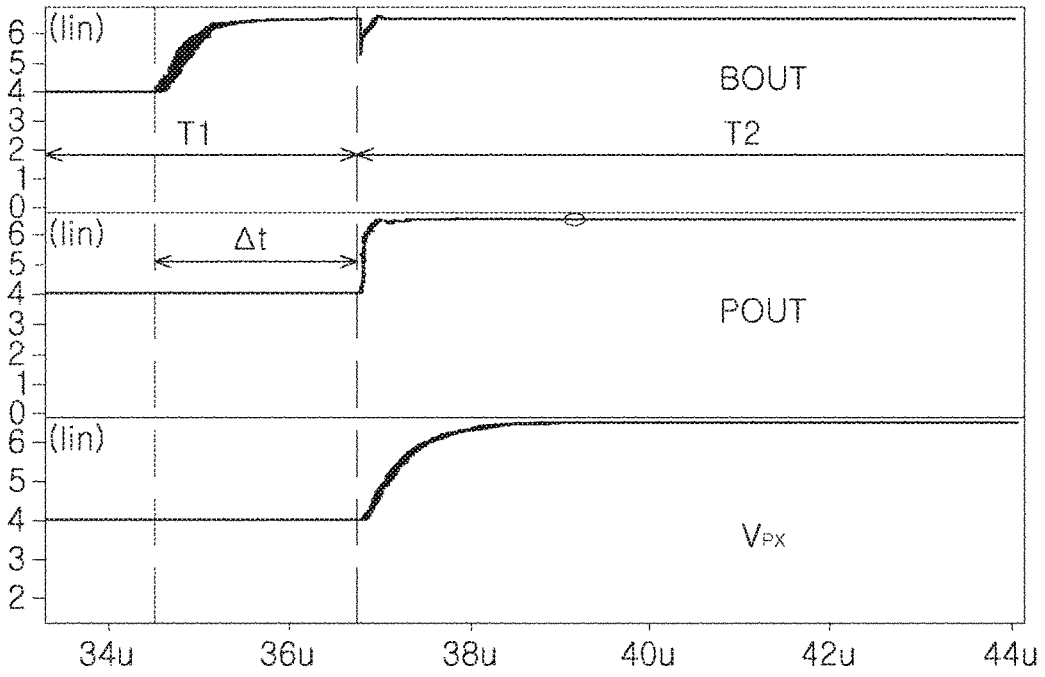
FIG. 6 is a waveform diagram provided to illustrate operations of a display driving device according to at least one example embodiment.
Figure 7:
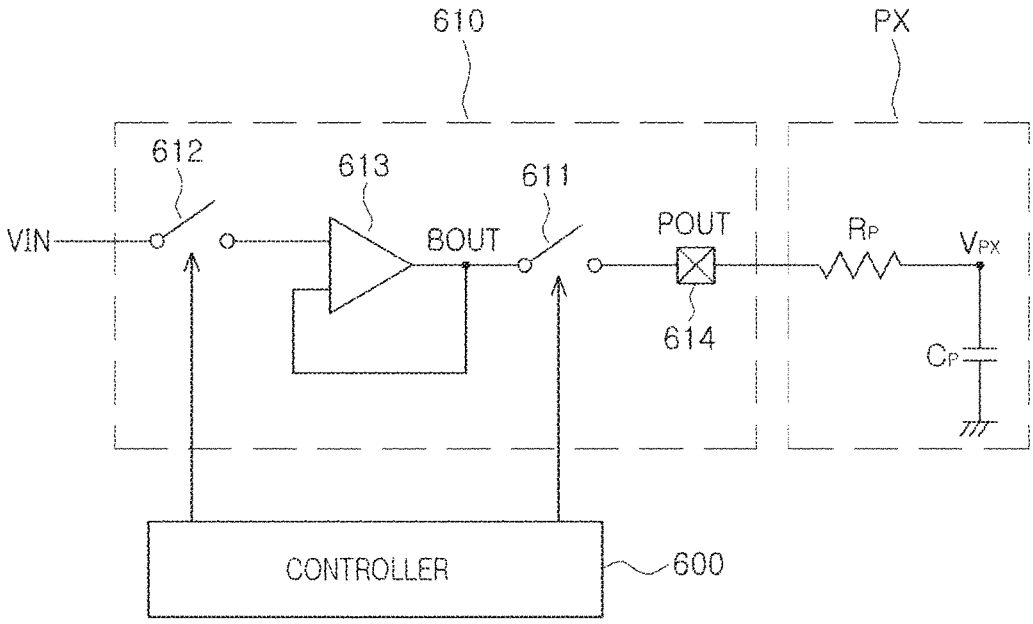
FIG. 7 is a circuit diagram provided to illustrate operations of a buffer circuit included in a display driving device according to at least one example embodiment.

FIG. 6 is a waveform diagram provided to illustrate operations of a display driving device according to at least one example embodiment. FIG. 7 is a circuit diagram provided to illustrate the waveform diagram illustrated in FIG. 6 according to at least one example embodiment.

The waveform diagram illustrated in FIG. 6 illustrates a pad output signal POUT, a pixel voltage $V_{PX}$, and a buffer output signal BOUT in relation to the circuit diagram illustrated in FIG. 7. With reference to FIG. 7, a buffer circuit 610 may include a first switch 611 and a second switch 612, a buffer 613, a pad 614, and the like, but is not limited thereto. The first switch 611 may be connected between an output terminal BOUT of the buffer 613 and the pad 614, and the second switch 612 may be connected to an input terminal of the buffer 613. The pad 614 may output a signal POUT based on the inputted BOUT signal. In addition, a controller 600 may control the first switch 611 and the second switch 612.

A pixel PX may be connected to the pad 614 through a data line, and may be illustrated as an equivalent circuit of a resistance Rp and a capacitor Cp, but is not limited thereto. In at least one example embodiment, the capacitor Cp may be a storage capacitor located in each pixel PX, and the resistance Rp may be a resistance component located in a data line, a turned-on transistor, or the like.

With reference to FIG. 6, the buffer output BOUT may be updated in advance during a time Δt of a period T1. So as not to input the buffer output BOUT that was updated in advance during the time Δt to the pixel PX, the first switch 611 may be turned-off during the time Δt. Meanwhile, in order to update the buffer output BOUT in advance during the time Δt, the second switch 612 may be turned-on. The buffer output BOUT is then updated in advance, and may be a data voltage to be input to the pixel PX during a period T2.

With reference to FIG. 6, after the period T2 begins, the buffer output BOUT may be applied (e.g., transmitted) to the pad output POUT. In at least one example embodiment, a slew time required to change the buffer output BOUT during the period T2 may be included in the time Δt of the period T1. In addition, as illustrated in FIG. 6, the pad 614 may have a response speed faster than that of the buffer 613, and therefore, has a fast slew rate. Thus, a time for charging the capacitor $C_P$ included in the pixel PX may be sufficiently secured (e.g., provided for, accounted for, etc.) during the period T2. As a result, the time for charging the pixel PX is sufficiently secured to reduce and/or prevent an image displayed by the display device from being degraded, and allows for the operation of the display device with low power consumption.

Figure 8:
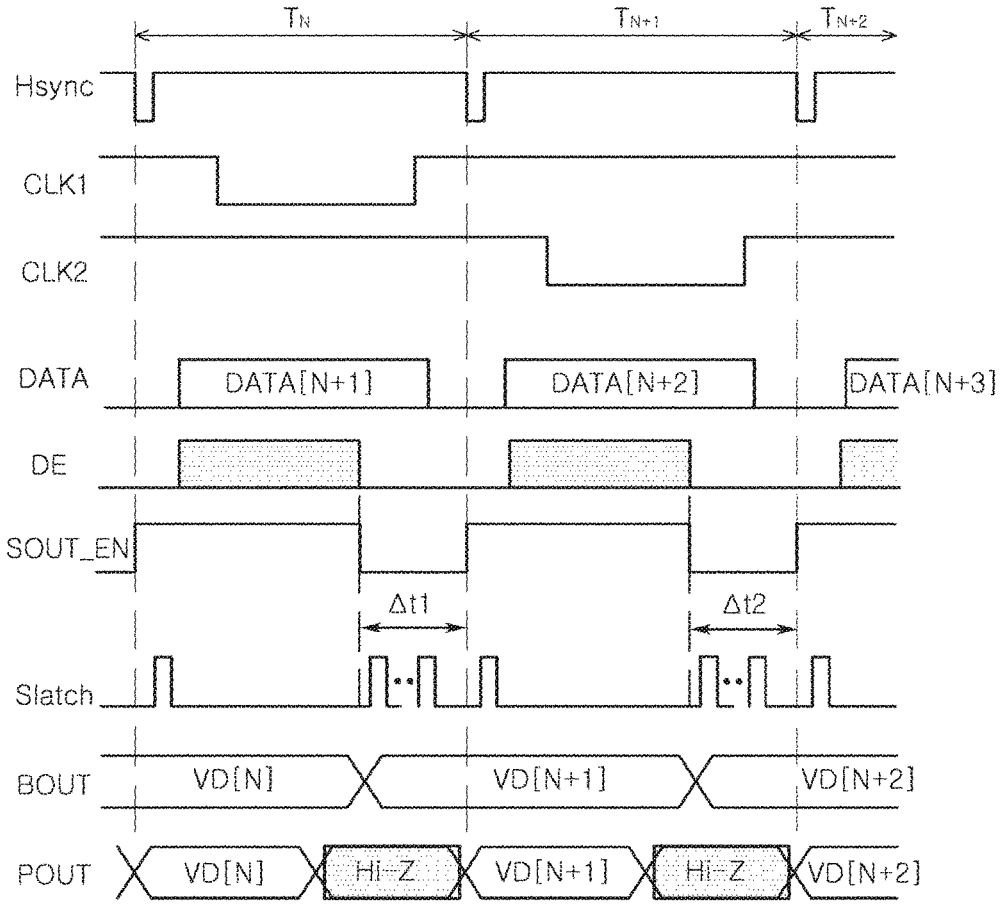
FIG. 8 is a timing diagram provided to illustrate a method of operating a display driving device according to at least one example embodiment.

FIG. 8 is a timing diagram provided to illustrate a method of operating a display driving device according to at least one example embodiment. Hereafter, the timing diagram illustrated in FIG. 8 will be described with reference to the display driving device 500 illustrated in FIG. 4.

In at least one example embodiment, at least a portion of the plurality of buffers 243 included in the data driver 200, may store a data voltage VD to be supplied to a data line DL during a subsequent period of the horizontal synchronization signal Hsync, in advance. In at least one example embodiment illustrated in FIG. 8, a time for updating the output of at least a portion of the plurality of buffers 243 in advance, e.g., Δt1, Δt2, or the like, may be determined based on a data enable signal DE. The data enable signal DE may be a signal for detecting whether the latch 220 has completed the sampling and storing of the digital image data DATA.

In the timing diagram illustrated in FIG. 8, during a period $T_N$, the buffer circuit 240 may output a data voltage VD[N] and the latch 220 may sample and store digital image data DATA[N+1]. The digital image data DATA[N+1] stored by the latch 220 during the period $T_N$ may be data corresponding to a data voltage VD[N+1] to be output by the buffer circuit 240 during a period $T_{N+1}$.

The data enable signal DE may have a high level (e.g., may be high) while the latch 220 samples or stores the digital image data DATA[N+1], and the level of the data enable signal DE may be changed to be a low level (e.g., may go low) when the latch 220 completes the storing of the digital image data DATA[N+1]. When the level of the data enable signal DE is changed to be low level, the controller 400 allows (and/or instructs) the first switch 241 to be turned off and allows (and/or instructs) the second switch 242 to be turned on during the time Δt1. During the time Δt1, output of at least a portion of the plurality of buffers 243 may be updated to the data voltage VD[N+1] (e.g., the advance value or the next value) corresponding to the digital image data DATA[N+1] stored in the latch 220.

When the period $T_{N+1}$ begins, the controller 400 allows (e.g., instructs or controls) the first switch 241 to be turned on through the first control signal SOUT_EN to apply (e.g., transmit) the buffer output BOUT updated in advance to the data voltage VD[N+1] corresponding to the digital image data DATA[N+1] during the time Δt1, to the pad output POUT. The pad 244 may have a slew rate that is relatively faster and/or is faster than that of the buffer 243. Thus, a relatively long time for charging a pixel PX may be secured by the data voltage VD[N+1] during the period $T_{N+1}$ by pre-applying the buffer output BOUT prior to the beginning of the period $T_{N+1}$.

Figure 9:
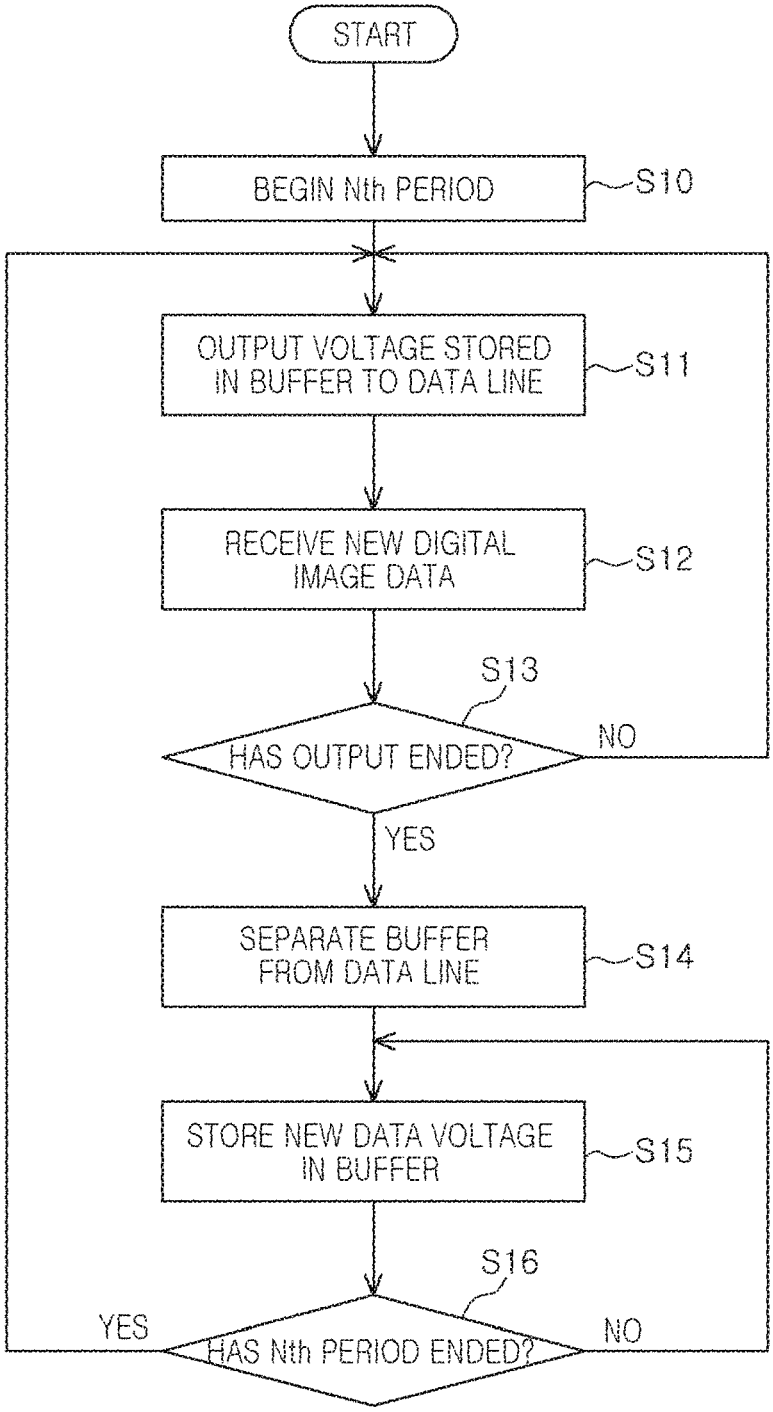
FIG. 9 is a flow chart provided to illustrate a method of operating a display driving device according to at least one example embodiment.

FIG. 9 is a flow chart provided to illustrate a method of operating a display driving device according to at least one example embodiment. Hereafter, operations of the display driving device 500 according to the flow chart illustrated in FIG. 9 will be described with reference to FIGS. 5 and 6 for convenience of explanation.

With reference to FIG. 9, operations of the display driving device 500 according to at least one example embodiment may begin when an Nth period begins (S10). For example, the Nth period may correspond to the period $T_N$ of the horizontal synchronization signal Hsync in the timing diagram illustrated in FIG. 5, but is not limited thereto. When the Nth period $T_N$ begins, the controller 400 may allow (e.g., instruct or control) the first switch 241 to be turned-on to output the data voltage VD[N] stored in the buffer 243 to the data line DL (S11).

While the data voltage VD[N] is being output, the latch 220 may receive a new digital image data value DATA[N+1] (S12). The digital image data DATA[N+1] received in S12, may be stored in the latch 220, and may be converted to new data voltage VD[N+1] by the digital-to-analog converter 230 during the period that the data voltage VD[N] is being output. The controller 400 allows the second switch 242 to be turned-off to prevent the new data voltage VD[N+1] that is being generated by the digital-to-analog converter 230 from being reflected in the output of the buffer 243 (e.g., transmitted to the buffer 243).

The controller 400 may determine whether the output of the data voltage VD[N] stored in the buffer 243 has ended (S13). As a result of the determination at S13, when the output of the data voltage VD[N] is determined to have not ended (e.g., the output has not been completed), the controller 400 allows (e.g., instructs or controls) the first switch 241 to be turned-on (e.g., continuously turned-on) so as to output the data voltage VD[N] stored in the buffer 243 to the data line DL.

Meanwhile, as a result of determination at S13, when the output of the data voltage VD[N] is determined to have ended (or completed), the controller 400 allows (e.g., instructs or controls) the first switch 241 to be turned-off to electrically isolate the buffer 243 from the data line DL (S14). Next, the controller 400 allows (e.g., instructs or controls) the second switch 242 to be turned-on to store the data voltage VD[N+1] output by the digital-to-analog converter 230, in the buffer 243 (S15). The data voltage VD[N+1] stored in the buffer 243 in S15, may be a voltage to be input to the data line DL during the N+1th period $T_{N+1}$ following the Nth period $T_N$.

The controller 400 may allow (e.g., instructs or controls) the buffer 243 to store the data voltage VD[N+1], and may determine whether the Nth period $T_N$ has ended (S16). As a result of the determination at S16, when the Nth period $T_N$ has not ended (e.g., has not completed), the controller 400 may allow (e.g., continuously allow) the buffer 243 to store the data voltage VD[N+1] therein. The buffer 243 may be a plurality of buffers that are provided in a number that corresponds to the number of data lines DL, and the data driver 200 may include the plurality of buffers 243. Thus, until the Nth period $T_N$ has ended, the controller 400 may allow each of the plurality of buffers 243 to store the data voltage VD[N+1] output by the digital-to-analog converter 230.

As a result of the determination at S16, when the Nth period $T_N$ has ended and the N+1th period $T_{N+1}$ begins, the controller 400 allows (e.g., instructs or controls) the first switch 241 to be turned-on to output the data voltage VD[N+1] stored in the buffer 243 to the data line DL (S11). As the output of the buffer 243, having a relatively slow slew rate, is updated in advance during the Nth period $T_N$, the previous period, the time for charging a pixel PX may be sufficiently secured through the data line DL during the N+1th period $T_{N+1}$.

Meanwhile, in at least one example embodiment illustrated in FIG. 9, S13 may be replaced with an operation of determining whether reception of a new digital image data DATA[N+1] of the controller 400 has been completed. In this case, the controller 400 may determine whether the reception of the new digital image data DATA[N+1] has been completed, by using the data enable signal DE as illustrated in FIG. 8.

Figure 10:
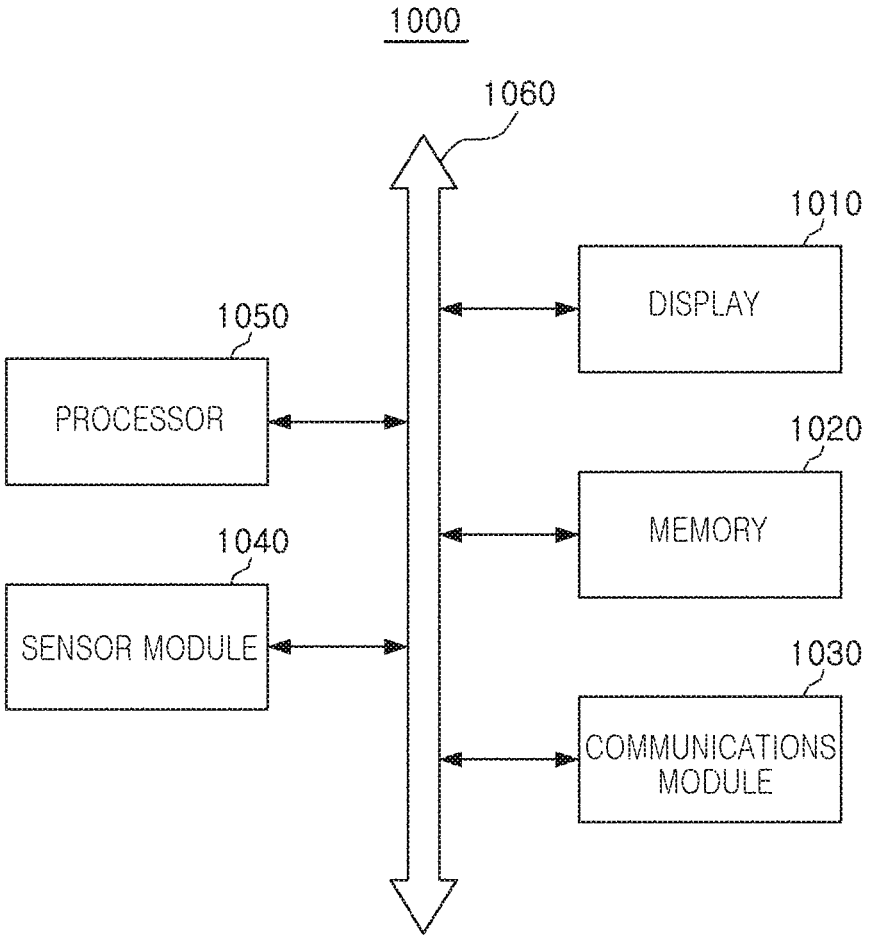
FIG. 10 is a block diagram provided to illustrate an electronic device to which a display device according to at least one example embodiment is applied.

FIG. 10 is a block diagram illustrating an electronic device to which a display device according to at least one example embodiment is applied.

With reference to FIG. 10, an electronic device 1000 according to at least one example embodiment may include a display device 1010, a memory 1020, a communications module 1030, a sensor module 1040, at least one processor 1050, and the like. The electronic device 1000 may include a television, a desktop computer, a gaming console, an Internet of Things (IoT) device, or the like, in addition to a mobile device, such as a smartphone, a tablet PC, a laptop computer, a personal navigation device, a wearable smart device, a virtual reality (VR) device, an augmented reality (AR) device, or the like. Components, such as the display device 1010, the memory 1020, the communications module 1030, the sensor module 1040, the processor 1050, and the like may communicate with each other through a bus 1060.

The display device 1010 may include a display driving device according to various example embodiments of the present inventive concepts, such as the various example embodiments discussed above. The display device 1010 according to at least one example embodiment, may store a data voltage to be output to a data line in each scanning period of the gate line, in a buffer of a data driver in advance during a previous scanning period. Thus, the slew time required to change an output of the buffer to the data voltage during each scanning period of the gate line may be significantly reduced, the image quality of the display device 1010 may be improved, and the display device 1010 may be operated with lower power consumption.

As set forth above, according to various example embodiments of the present inventive concepts, a display driving device may allow at least a partial output of a plurality of buffers connected to a plurality of data lines to be updated in advance of the image data to be output to the plurality of data lines during a subsequent period. Thus, when the subsequent period arrives, the effect of the slew time of a plurality of operational amplifiers on the time for charging one or more of the pixels of a display panel may be significantly reduced, and distortion, degradation, and the like, of an image being displayed by the display device may be reduced and/or prevented. Further, power consumption of the display device may be reduced.

It should be understood that example embodiments described herein should be considered in a descriptive sense only and not for purposes of limitation. Descriptions of features or aspects within each device or method according to example embodiments should typically be considered as available for other similar features or aspects in other devices or methods according to example embodiments. While some example embodiments have been particularly shown and described, it will be understood by one of ordinary skill in the art that variations in form and detail may be made therein without departing from the spirit and scope of the claims.

As is traditional in the field of the inventive concepts, various example embodiments are described, and illustrated in the drawings, in terms of functional blocks, units and/or modules.ous example embodiments are described, and illustrated in the or purposes of limitation. Descriptions of feature electronic (or optical) circuits such as logic circuits, discrete components, microprocessors, hard-wired circuits, memory elements, wiring connections, and the like, which may be formed using semiconductor-based fabrication techniques or other manufacturing technologies. In the case of the blocks, units and/or modules being implemented by microprocessors or similar processing devices, they may be programmed using software (e.g., microcode) to perform various functions discussed herein and may optionally be driven by firmware and/or software, thereby transforming the microprocessor or similar processing devices into a special purpose processor. Additionally, each block, unit and/or module may be implemented by dedicated hardware, or as a combination of dedicated hardware to perform some functions and a processor (e.g., one or more programmed microprocessors and associated circuitry) to perform other functions. are described, and illustrated in the drawings, in terms of functhysically separated into two or more interacting and discrete blocks, units and/or modules without departing from the scope of the inventive concepts. Further, the blocks, units and/or modules of the embodiments may be physically combined into more complex blocks, units and/or modules without departing from the scope of the inventive concepts.

What is claimed is:

1. A display driving device comprising:

a digital-to-analog converter configured to generate analog image data;

a plurality of pads connected to a plurality of data lines included in a display panel;

a buffer circuit including a plurality of buffers, a first switch, and a second switch, the plurality of buffers are each configured to generate first data voltages based on the analog image data, the first switch connected between output terminals of the plurality of buffers and input terminals of the plurality of pads, and the second switch connected between input terminals of the plurality of buffers and an output of the digital-to-analog converter and the second switch configured to receive the analog image data output from the digital-to-analog converter and input the analog image data to the plurality of buffers, and the plurality of buffers are each further configured to output the generated first data voltage to at least one of the plurality of data lines through the plurality of pads during a first scanning period; and a controller configured to turn the first switch off and turn the second switch on to set an output of at least one buffer of the plurality of buffers from the first data voltage to a second data voltage during the first scanning period while the other buffers of the plurality of buffers output the first data voltage to the at least one of the plurality of data lines, and the at least one buffer is further configured to output the second data voltage during a second scanning period.

2. The display driving device of claim 1, wherein the plurality of buffers are each configured to receive the analog image data generated by the digital-to-analog converter to generate the data voltage for a respective scanning period corresponding to the generated analog image data.

3. The display driving device of claim 2, wherein the controller is configured to turn the first switch off and turn the second switch on to set the output of at least one of the plurality of buffers to a third data voltage to be output to the plurality of data lines, after output of the second data voltage has been completed for a second scanning period, during a third scanning period.

4. The display driving device of claim 3, wherein the controller is configured to turn the first switch on to output the third data voltage to the plurality of data lines when the third scanning period begins.

5. The display driving device of claim 3, wherein the controller is configured to turn the second switch on to set outputs of the plurality of buffers as the third data voltage when the third scanning period begins.

6. The display driving device of claim 1, wherein the controller is configured to repeatedly turn the second switch on and off while the first switch is turned off.

7. The display driving device of claim 1, further comprising:

a latch circuit configured to sample and store digital image data; and a shift register configured to control a sampling timing of the latch circuit that causes the latch circuit to sequentially store the digital image data; wherein the digital-to-analog converter is configured to generate the analog image data based on the sampled and stored digital image data.

8. The display driving device of claim 7, wherein the controller is configured to generate a first control signal and a second control signal for controlling the first switch and the second switch, respectively; and the latch circuit is configured to transfer the sampled and stored digital image data to the digital-to-analog converter based on the second control signal.

9. The display driving device of claim 7, wherein the controller is configured to transmit a third control signal to the shift register to determine a desired scanning period in which the plurality of buffers output the data voltage.

10. The display driving device of claim 1, wherein the display panel includes a plurality of first pixels disposed in an area in which a first gate line intersects the plurality of data lines, and a plurality of second pixels disposed in an area in which a second gate line intersects the plurality of data lines; and the plurality of buffers are each configured to input the first data voltage to the plurality of first pixels during the first scanning period in which the first gate line is activated, and input the second data voltage to the plurality of second pixels during a second scanning period in which the second gate line is activated.

11. The display driving device of claim 10, wherein the controller is configured to set an output of at least one of the plurality of buffers to the second data voltage during the first scanning period.

12. A display driving device comprising:

a latch circuit configured to sample and store digital image data;

a shift register configured to control a sampling timing of the latch circuit;

a digital-to-analog converter configured to generate analog image data based on the digital image data stored in the latch circuit;

a plurality of buffers configured to;

receive the analog image data, and generate a first data voltage based on the received analog image data, and output the first data voltage to a plurality of data lines through a plurality of pads after a delay time has elapsed, the delay time corresponding to a first scanning period;

the plurality of pads connecting output terminals of each of the plurality of buffers to the plurality of data lines; and at least one buffer of the plurality of buffers configured to receive a second data voltage during the first scanning period.

13. The display driving device of claim 12, wherein the latch circuit includes a plurality of latches, and the plurality of latches are configured to sequentially sample and store the digital image data based on the sampling timing.

14. The display driving device of claim 12, further comprising:

a plurality of first switches connecting the plurality of buffers to the plurality of pads;

a plurality of second switches connecting the plurality of buffers to the digital-to-analog converter; and a controller configured to control the plurality of first switches and the plurality of second switches and control the delay time.

15. The display driving device of claim 14, wherein the controller is configured to turn the plurality of first switches off and turn at least one of the plurality of second switches on, during the delay time.

16. The display driving device of claim 15, wherein the at least one of the plurality of buffers is configured to store the data voltage, during the delay time.

17. A display device comprising:

a display panel having a plurality of first pixels disposed on a first gate line, and a plurality of second pixels disposed on a second gate line;

a data driver including a plurality of buffers and configured to, output a first data voltage to the plurality of first pixels of the display panel during a first period, and output a second data voltage to the plurality of second pixels of the display panel during a second period following the first period;

a controller configured to update an output of at least one buffer of the plurality of buffers of the data driver to the second data voltage; during the first period, while the other buffers of the plurality of buffers output the first data voltage; and the at least one buffer is further configured to output the second data voltage during the second period.

18. The display device of claim 17, further comprising:

a gate driver configured to transmit a gate driving signal to the first gate line during the first period, and transmit the gate driving signal to the second gate line during the second period.

19. The display device of claim 17, wherein the data driver comprises:

a digital-to-analog converter configured to generate first analog image data and second analog image data, the first analog image data and the second analog image data used at least in part to generate the first data voltage and the second data voltage, respectively;

a latch circuit configured to sample and store first digital image data and second digital image data, the first digital image data and the second digital image data used at least in part to generate the first analog image data and the second analog image data, respectively;

a shift register configured to control a sampling timing of the latch circuit; and each of the plurality of buffers includes, an output terminal connected to a respective one of the plurality of first pixels and a respective one of the plurality of second pixels via a first switch, and an input terminal connected to the digital-to-analog converter via a second switch.

* * * * *